United States Patent [19]

Okazaki et al.

[11] 4,326,600

[45] Apr. 27, 1982

[54] INTAKE SILENCER FOR OUTBOARD MOTOR

[75] Inventors: Masaki Okazaki, Iwata; Ryozo Ohkita, Hamamatsu, both of Japan

[73] Assignee: Yamaha Hatsudoki Kabushiki Kaisha, Iwata, Japan

[21] Appl. No.: 154,773

[22] Filed: May 30, 1980

[30] Foreign Application Priority Data

Jun. 8, 1979 [JP] Japan ..... 54-72771

[51] Int. Cl.[3] ..... F02M 35/12; F01N 1/02

[52] U.S. Cl. ..... 181/229; 181/276; 440/88

[58] Field of Search ..... 123/198 E; 55/276; 181/204, 276, 229, 273, 266; 440/88, 900

[56] References Cited

U.S. PATENT DOCUMENTS

| | | | |
|---|---|---|---|
| 2,322,895 | 6/1953 | Steensen | 181/229 X |
| 2,798,470 | 7/1957 | Kiekhaefer | 181/229 X |
| 2,839,042 | 6/1958 | Armstrong et al. | 181/229 X |

FOREIGN PATENT DOCUMENTS

| | | | |
|---|---|---|---|
| 216292 | 7/1961 | Austria | 181/229 |
| 1052144 | 9/1953 | France | 181/229 |

*Primary Examiner*—Lawrence R. Franklin
*Assistant Examiner*—Thomas H. Tarcza
*Attorney, Agent, or Firm*—Donald D. Mon

[57] ABSTRACT

An outboard motor includes a cowling with a cavity that receives a carburetor that supplies the engine with an air/fuel mixture. The carburetor has an air intake port. An air intake passage connects to this port, and bends partway around the carburetor. A resonance chamber communicates with the air intake passage and faces the carburetor to attenuate the noise from the carburetor intake port.

16 Claims, 3 Drawing Figures

INTAKE SILENCER FOR OUTBOARD MOTOR

Field of the Invention

This invention relates to an intake silencer for an outboard engine to be attached to the stern transom of a small-sized vessel.

Background of the Invention

The noises of an outboard engine come principally from its intake system. In order to reduce the noises of the intake system, it is necessary to provide some silencer in the intake system. The cowling, which forms the contour of the outboard engine and which accommodates the engine unit and its carburetor, is conceivable as the place for mounting that silencer. However, the cowling has a limitation in its space capacity (especially in its longitudinal capacity). Moreover, if the design and/or the internal structure of the outboard engine are changed in order to mount the silencer, these changes are not desirable because the production cost of the outboard engine is accordingly raised. From this background, there has never been proposed in the prior art a silencer which can be accommodated in a cowling which has the aforementioned spatial limitation.

With these circumstances taken into consideration, therefore, it is an object of the present invention to provide an intake silencer which can not only attain the desired sufficient siliencing effect but also be accommodated in such a cowling of an outboard engine as has a spatial limitation especially, in its longitudinal direction.

Brief Description of the Invention

This invention is carried out in an outboard engine that has an external cowling with an internal cavity that holds the engine and a carburetor that supplies the engine with air/fuel mixture. The carburetor has an air intake port. An air intake passage connects to this port and bends partway around the carburetor. A resonance chamber communicates with this passage, and extends along the bent air intake passage.

The above and other features of this invention will be fully understood from the following detailed description and the accompanying drawings, in which:

Detailed Description of the Invention

Figure 1:
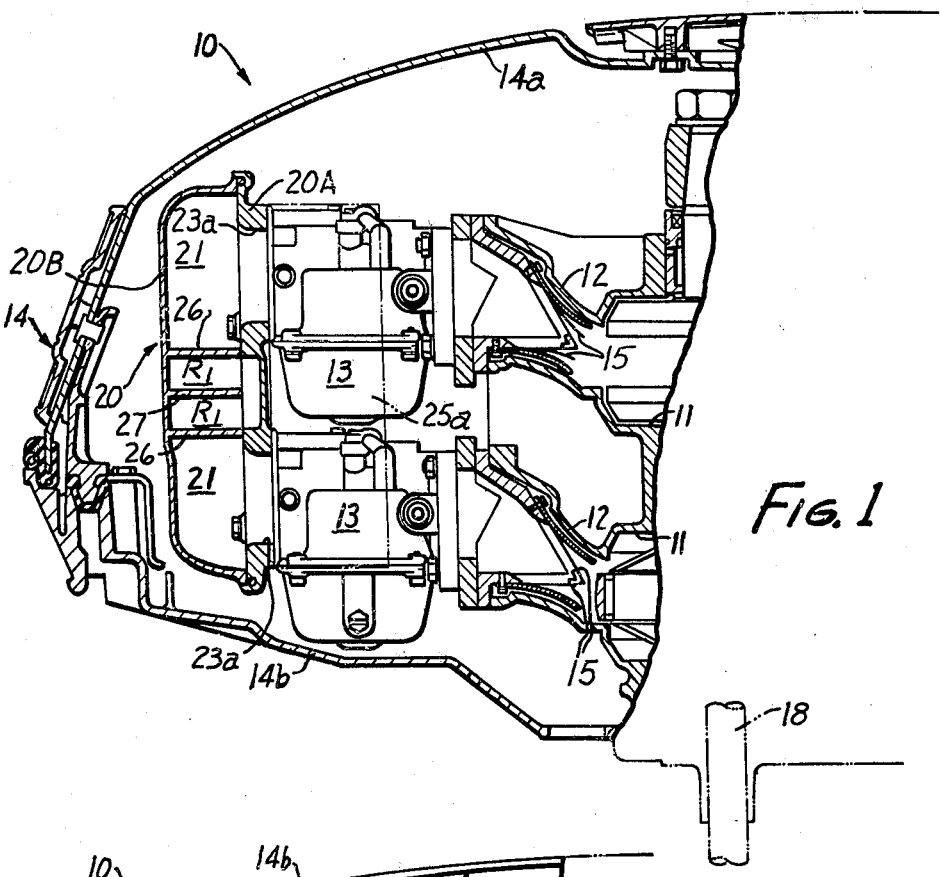
FIG. 1 is a vertical section showing portions of an outboard engine incorporating the invention.

FIG. 1 shows the front portion of an outboard engine 10 to be attached to the stern. The outboard engine 10 is equipped, as shown, with intake pipes 12, which are respectively connected to the crank chambers 11 of a two-stroke engine unit having two upper and lower cylinders arranged in parallel with each other and which are made to extend to the front (or in the leftward direction, as shown), and with carburetors 13 which are respectively mounted in intake pipes 12. Because the carburetor and silencer systems are duplicated, the same number is used for their parts, as appropriate. The engine unit, intake pipes 12 and carburetors 13 are accommodated in a cavity in cowling 14 which forms the contour of the outboard engine 10. Cowling

Figure 2:
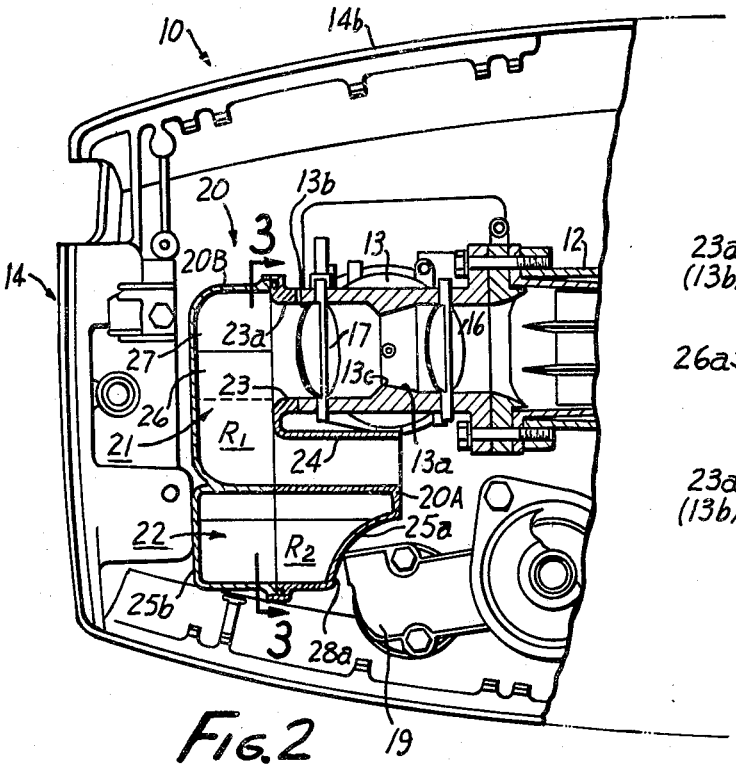
FIG. 2 is a horizontal top view of FIG. 1, with portions removed, and portions in section.

14 is composed of upper and lower cowling members 14*a* and 14*b* such that the lower cowling member 14*b* covers the lower portions of the aforementioned engine unit and carburetors 13 whereas the upper cowling member 14*a* is seated on the lower cowling member 14*b* to cover the upper portions of the engine unit and the like. As shown in FIGS. 1 and 2, moveover, a reed valve 15 is mounted in each intake pipe 12 of the outboard engine 10. A throttle valve 16 and a choke valve 17 are mounted in the intake passage 13*a* of each carburetor 13. To the front ends (the lefthand ends of the drawings) of the respective carburetors 13 and 13, there is attached an intake silencer 20 according to the present invention. In FIG. 1, incidentally, reference numeral 18 indicates a drive for the propeller (not shown) mounted at the lower end thereof.

Figure 3:
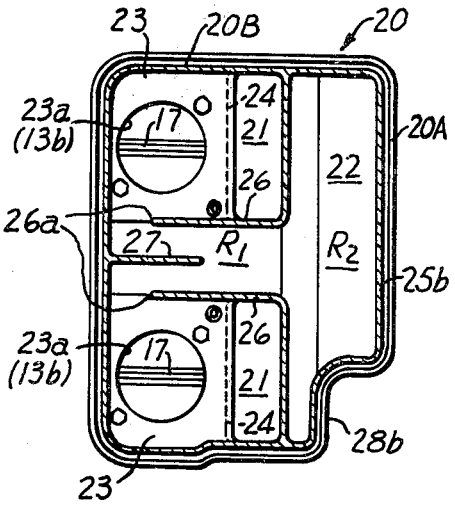
FIG. 3 is a vertical section taken at line 3—3 in FIG. 2.

As best shown in FIGS. 1 and 2, the intake silencer 20 is comprised of a body 20A and a cover 20B which is hermetically attached to the open front end of the body 20A. The intake silencer 20 is formed with upper and lower air intake passage 21 and a resonance chamber 22. As best seen in FIGS. 2 and 3, the silencer body 20A is hermetically attached at the upper and lower mounting bases 23 to the front ends of the respective carburetors 13. Each mounting base 23 is formed with an opening 23*a* which is made coextensive with the intake port 13*b* of each carburetor 13. Moreover, the silencer body 20A is equipped with a pair of upper and lower cylinders 24 which are made to extend backward along the sides of the respective carburetors 13 until they are opened at their rear ends. There is formed integral with the two cylinders 24 a casing 25*a* which is disposed at the opposite sides of cylinders 24 to those facing the carburetor 13. Casing 25*a*, thus disposed, is formed at the rear and lower portions thereof, as best seen in FIGS. 2 and 3, with recesses 28*a* and 28*b*, respectively, which provide room for preventing interference with other members in the cowling 14 such as a relay 19 for a self-starter.

As best seen in FIG. 3, there are formed integrally with the silencer cover 20B a pair of upper and lower partitions 26 having L-shaped cross-sections, each of which encloses the opening 23*a* of respective mounting base 23 and the open front end of each cylinder 24 of the silencer body 20A. Moreover, each partition 26 is formed with a communicating port 26*a* in the vicinity of the opening 23*a* of each mounting base 23. The silencer cover 20B is formed with a first chamber $R_1$ which is defined by the two partitions 26, while communicating with the openings 23*a* of the respective mounting bases 23 through the respective communicating ports 26*a*. Cover 20B is further formed integrally with a baffle plate 27 which is interposed between the two partitions 26 in a manner to have both sides facing the respective communicating ports 26*a*. The cover 20B is further formed integrally with a casing 25*b* which is fitted on the casing 25*a* of the silencer body 20A. As a result, by the casing 25*b* of the cover 20B and the casing 25*a* of the body 20A, there is formed a second chamber $R_2$ which is disposed at the sides of the two carburetors 13 while communicating with the first chamber $R_1$. As best seen in FIG. 2, the respective partitions 26 and the baffle plate 27 are made to abut against the silencer body 20A at their righthand edges, as viewed in the drawing.

Thus, in the intake silencer 20 being described, there are formed the paired upper and lower air intake passages 21, each of which has its one end communicating with the intake port 13*b* of each carburetor 13 to extend to the front of the carburetor 13 and which is bent to extend along the side of the carburetor 13 until its other end opens into the cowling 14. In the intake silencer 20, moreover, there are formed both the first chamber $R_1$ between the upper and lower air intake passages 21 and the second chamber $R_2$ which is disposed at the sides of the respective air intake passages 21, facing the respective carburetors 13 and extending in the vertical direction. First and second chambers $R_1$ and $R_2$ constitute the aforementioned resonance chamber 22, which is made to have communication with the respective air intake passages 21 through the respective communicating ports 26*a*. In this instance, the resonance chamber 22 has its resonance frequency set at such a proper level as can correspond to the frequency of the noises generated at the sides of the respective carburetors 13.

Thus, when the engine unit of the outboard engine 10 to which the intake silencer 20 thus constructed is attached is operated, noises are generated at the venturi 13*c* of each carburetor 13 and by the action of each reed valve 15, but can be attenuated such that their energy is absorbed by the resonance in the resonance chamber 22 of the intake silencer 20. As a result, little noise escapes from the respective cylinders 24 into the cowling 14. In the intake silencer 20, moreover, the resonance chamber 22 is composed of both the first chamber $R_1$, which is formed to make use of the dead space between the upper and lower air intake passages 21 which in turn are formed in front of the respective carburetors 13, and the second chamber $R_2$ which is formed to make use of the space at the sides of the respective carburetors 13. As a result, the intake silencer 20 under consideration can retain the resonance chamber 22, which has a relatively large capacity and a desired resonance frequency, without occupying much space in the longitudinal direction and can be accommodated in the spatially limited cowling 14 without interference with other members.

The resonance frequency of the resonance chamber 22 can be determined by suitably setting the volumes of the first and second chambers $R_1$ and $R_2$. In the intake silencer 20 thus far described, the second chamber $R_2$ constituting the major portion of the resonance chamber 22 is disposed at the opposite sides of the respective air intake passages to those facing the carburetors 13. As a result, the intake silencer 20 can be free from any interference with the actuating mechanisms of the throttle valve and choke valves 16 and 17 of each carburetor 13. Incidentally, the baffle plate 27 used in the present embodiment functions to prevent the noises generated at the upper and lower carburetors 13 from being composed and amplified, but sufficient benefits can still be obtained even if the baffle plate 27 is not used. Also, each air intake passage 21 is opened toward the crankcase of the engine unit at the back thereof so that its opening is spaced apart from the jointed portions between the upper and lower cowling members 14*a* and 14*b*, where water may possibly enter. As a result, even if water enters into the cowling 14, it is not likely to be sucked into the respective air intake passages 21.

As a result, the intake silencer 20 according to the present invention can attain sufficient silencing effects and can be accommodated in the spatially limited cowling 14 of the outboard engine 10 without any change in the remaining portions.

In the foregoing embodiment, incidentally, although the first chamber $R_1$ is formed between the upper and lower air intake passages 21, the present invention is not to be limited thereto, but can be exemplified such that the first chamber $R_1$ is formed either above the upper air intake passages 21 or below the lower air intake passage 21. Moreover, the present invention can be applied not only to an outboard engine 10 having two engine units, as has been exemplified in the aforementioned embodiment, but also to an outboard engine having a single engine unit or three or more engine units.

As has been described hereinbefore in detail, the present invention is constructionally characterized, as exemplified by the aforementioned embodiment, by the provision of both the air intake passage 21 having its one end communicating with the intake port 13*b* of the carburetor 13, which is accommodated in the cowling 14 of the outboard engine 10, to extend to the front of the carburetor 13 to its other (open) end, and the resonance chamber 22 disposed at the opposite side of the air intake passage 21 to the side facing the carburetor 13, while communicating with the air intake passage 21 and having its portion extending along the upper or lower side of the air intake passage 21. Therefore, the present invention can provide an intake silencer which can attain sufficient silencing effects and which can be accommodated in a longitudinally short cowling.

This invention is not to be limited to the embodiments shown in the drawings and described in the description, which are given by way of example and not of limitation, but only in accordance with the appended claims.

We claim:

1. An intake silencer for an outboard engine and a carburetor attached to said engine, said carburetor having an air intake port, said silencer comprising: an air intake passage having an open end and an end connected to said air intake port, said air intake passage bending partway around said carburetor, and a resonance chamber in fluid communication with said air intake passage between its ends, and also bending partway around said carburetor, in near adjacency to said air intake passage.

2. Apparatus according to claim 1 in which a portion of said resonance chamber is disposed on the other side of said air intake passage from said carburetor, which has a substantial dimension lateral to said air intake passage.

3. Apparatus according to claim 2 in which said resonance chamber comprises a first chamber directly connected to said air intake passage, and a second chamber connected only to said first chamber, said second chamber constituting at least part of said portion.

4. Apparatus according to claim 1 in which said air intake passage bends to extend substantially parallel to its inlet direction at the intake port of said carburetor, and in which said resonance chamber includes a portion substantially parallel to said parallel part of said intake passage.

5. Apparatus according to claim 4 in which a portion of said resonance chamber is disposed on the other side of said air intake passage from said carburetor, which has a substantial dimension lateral to said air intake passage.

6. Apparatus according to claim 5 in which said resonance chamber comprises a first chamber directly connected to said air intake passage, and a second chamber connected only to said first chamber, said second chamber constituting at least part of said portion.

7. Apparatus according to claim 6 in which said engine includes a pair of carburetors and air intake passages, said air intake passages being parallel to one another, and in which said first chamber is placed between them, and said second chamber is disposed laterally relative to them, both of said air intake passages being in communication with said first chamber.

8. Apparatus according to claim 7 in which a baffle plate is placed in said first chamber adjacent to its entry into said air intake passages initially to isolate pulses in one of said air intake passages from pulses in the other air intake passage.

9. Apparatus according to claim 1 in which said air intake port on said resonance chamber share a common wall between them.

10. Apparatus according to claim 9 in which a portion of said resonance chamber is disposed on the other side of said air intake passage from said carburetor, which has a substantial dimension lateral to said air intake passage.

11. Apparatus according to claim 10 in which said resonance chamber comprises a first chamber directly connected to said air intake passage, and a second chamber connected only to said first chamber, said second chamber constituting at least part of said portion.

12. Apparatus according to claim 11 in which said portion of said resonance chamber has a substantial vertical extent.

13. Apparatus according to claim 12 in which said engine includes a pair of said carburetors and said air intake passages, said air intake passages being parallel to one another, and in which said first chamber is placed between them, and said second chamber is disposed laterally relative to them, both of said air intake passages being in fluid communication with said first chamber, said first chamber being connected to said air inlet passages by communicating ports located adjacent to said air intake port of said carburetors, said ports facing toward one another.

14. Apparatus according to claim 13 in which a baffle plate is placed in said first chamber between said communicating ports, initially to isolate pulses in one of said air intake passages from pulses in the other air intake passage.

15. Apparatus according to claim 6 in which the first chamber is above or below said air intake passage.

16. Apparatus according to claim 11 in which the first chamber is above or below said air intake passage.

* * * * *